US006025109A

United States Patent [19]

Karashima et al.

[11] Patent Number: 6,025,109

[45] Date of Patent: Feb. 15, 2000

[54] METHOD FOR CLEANING A TRANSFER DEVICE OF AN IMAGE FORMING APPARATUS

[75] Inventors: Kenji Karashima; Hisashi Fuzisaki, both of Kawasaki, Japan

[73] Assignee: Ricoh Company, Ltd., Tokyo, Japan

[21] Appl. No.: 09/080,243

[22] Filed: May 18, 1998

Related U.S. Application Data

[62] Division of application No. 08/654,097, May 28, 1996, Pat. No. 5,822,649.

[30] Foreign Application Priority Data

May 26, 1995 [JP] Japan ..... 7-152393

[51] Int. Cl.[7] ..... G03G 21/00

[52] U.S. Cl. ..... 430/125; 430/126

[58] Field of Search ..... 430/125, 126

[56] References Cited

U.S. PATENT DOCUMENTS 5,450,180 9/1995 Ohzeki et al. .
5,559,590 9/1996 Arai et al. .
5,621,509 4/1997 Karashima et al. .
5,631,725 5/1997 Harasawa et al. .

FOREIGN PATENT DOCUMENTS 5-119646 5/1993 Japan .
5-341671 12/1993 Japan .

*Primary Examiner*—Maria Nuzzolillo
*Assistant Examiner*—Laura Werner
*Attorney, Agent, or Firm*—Oblon, Spivak, McClelland, Maier & Neustadt, P.C.

[57] ABSTRACT

A contact type image transferring system and method incorporated in an image forming apparatus for cleaning residual toner on a transfer roller. The transfer roller is in contact with a photoconductive drum and forms a nip between the roller and the drum. A sheet of paper passes through the nip and a toner image on the drum is transferred to the sheet of paper. A power source applies a first bias current which has the same polarity as regularly charged toner to the transfer roller from when the image carrier starts its rotation after an inputting of a print start request until the sheet reaches the nip. Then the power source applies a second bias current having the same polarity as the first bias current to the transferring device when the sheet is at the nip to transfer the toner image on the image carrier to the sheet.

6 Claims, 4 Drawing Sheets

| A \ B | − 3 μA | − 5 μA | −10 μA | − 15 μA | − 20 μA |
|---|---|---|---|---|---|
| + 3 μA | X | X | X | X | X |
| + 5 μA | X | X | X | X | X |
| +10 μA | X | X | X | X | X |
| +15 μA | X | X | X | X | X |
| +20 μA | X | X | X | X | X |

X: BACK SIDE OF PAPER BECAME DIRTY

| A \ B | − 3 μA | − 5 μA | −10 μA | − 15 μA | − 20 μA |
|---|---|---|---|---|---|
| + 3 μA | ○ | ○ | ○ | ○ | ○ |
| + 5 μA | ○ | ○ | ○ | ○ | ○ |
| +10 μA | X | ○ | ○ | ○ | ○ |
| +15 μA | X | X | ○ | X | ○ |
| +20 μA | X | X | X | ○ | X |

○: BACK SIDE OF PAPER REMAINED CLEAN
X: BACK SIDE OF PAPER BECAME DIRTY

METHOD FOR CLEANING A TRANSFER DEVICE OF AN IMAGE FORMING APPARATUS

This application is a Division of application Ser. No. 08/654,097, filed on May 28, 1996, now U.S. Pat. No. 5,822,649.

BACKGROUND OF THE INVENTION

1. Field of the Invention

The present invention relates to an image transferring device for an image forming apparatus such as a copier, printer, facsimile transceiver or similar photographic image forming apparatus in which an image is formed on a photoconductive element. More particularly, the invention is concerned with a contact type image transferring device including, for example, a transfer roller or a transfer belt for transferring a toner image from the photoconductive element to a sheet of paper which is passed through a nip between the photoconductive element and the image transferring device. The present invention further relates to a method and apparatus for electrically cleaning the transferring device.

2. Discussion of the Background

It is a common practice for an image forming apparatus of the type described above to use a contact type image transferring device. The contact type image transferring device such as a transfer roller has applied thereto an electrical field opposite in polarity to the polarity of a toner image on a photoconductive element. The image transferring device transfers the toner image from the photoconductive element to a sheet passed through a nip between the photoconductive element and the transfer device. Since the contact type transfer device is in direct contact with the photoconductive element when the sheet is not at the nip, the toner image on the surface of the photoconductive element transfers to the surface of the transfer device. Subsequently, the toner image on the transfer device is undesirably transferred to the back side of the sheet.

Japanese Laid-Open Patent No. 3-69978 discloses a cleaning device for a transfer roller in which toner on the surface of the roller is transferred to the photoconductive element by applying cleaning bias voltage to the transfer roller when the transfer roller is in direct contact with the photoconductive element. Namely, the cleaning bias voltage is applied during a pre-image forming time period (i.e., from the time the photoconductive element starts its rotation until the leading edge of an image area on the photoconductive element reaches the nip), an inter-image forming time period (i.e., between successive copying or toner image transfer operations), and a post-image forming time period (i.e., after the last image area on the photoconductive element passes through the nip). Since there is not only regularly charged toner having a positive polarity but also oppositely charged toner having a negative polarity, for cleaning both types of toner, this publication discloses that the polarity of a cleaning bias voltage is switched over between the positive polarity and the negative polarity.

Japanese Laid-Open Patent No. 51-9840 discloses a cleaning device for a transfer roller in which the transfer bias voltage having a polarity opposite to the polarity of the toner is applied to the transfer roller when a sheet of paper is at the nip, and the cleaning bias voltage having the same polarity as the toner is applied to the transfer roller when the sheet of paper is not at the nip.

Japanese Laid-Open Patent No. 2-39182 discloses a cleaning device for a transfer roller in which a cleaning bias voltage having the same polarity as the transfer bias voltage and a voltage value smaller than the transfer bias voltage is applied to the transfer roller when a sheet of paper is not at a nip between the transfer roller and a photoconductive element.

It is known that there is oppositely charged toner in a developing device. The oppositely charged toner is adhered to a non-image forming area of a photoconductive element when the photoconductive element faces a developing roller in the developing device. The oppositely charged toner on the photoconductive element is undesirably transferred to a transfer roller when an area of the photoconductive element where the oppositely charged toner is adhered reaches a nip between the photoconductive element and the transfer roller after the cleaning operation for the transfer roller is completed. When a sheet of paper passes through the nip, the oppositely charged toner on the transfer roller is undesirably transferred to a back side of the sheet of paper, and then the back side of the sheet of paper becomes dirty. Even if the cleaning operation for the transfer roller is executed during the cleaning time period, the aforementioned drawback cannot be solved, since this drawback occurs after the cleaning operation of the transfer roller. Therefore, the aforementioned publication does not solve this problem.

SUMMARY OF THE INVENTION

Accordingly, one object of this invention is to provide a novel image transferring device for an image forming apparatus which can solve the aforementioned drawbacks. A further object of the present invention is to provide an image transferring device for an image forming apparatus in which cleaning of a contact type transfer device is performed.

In order to achieve the above-mentioned objects, according to the present invention, an image forming apparatus includes an image carrier for carrying a toner image, a charging device which charges the image carrier, a transferring device which is in direct contact with the image carrier when a sheet of paper is not at a nip between the image carrier and the transferring device, a power source which applies a bias current to the transferring device. The image forming apparatus further includes a control device which controls the power source so as to apply a first bias current from when the image carrier starts its rotation in response to an inputting of a print request until the sheet reaches the nip. The control device controls the power source to apply a second bias current having the same polarity as the first bias current when the sheet is at the nip to transfer the toner image on the image carrier to the sheet.

Other objects and aspects of the present invention will become apparent herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
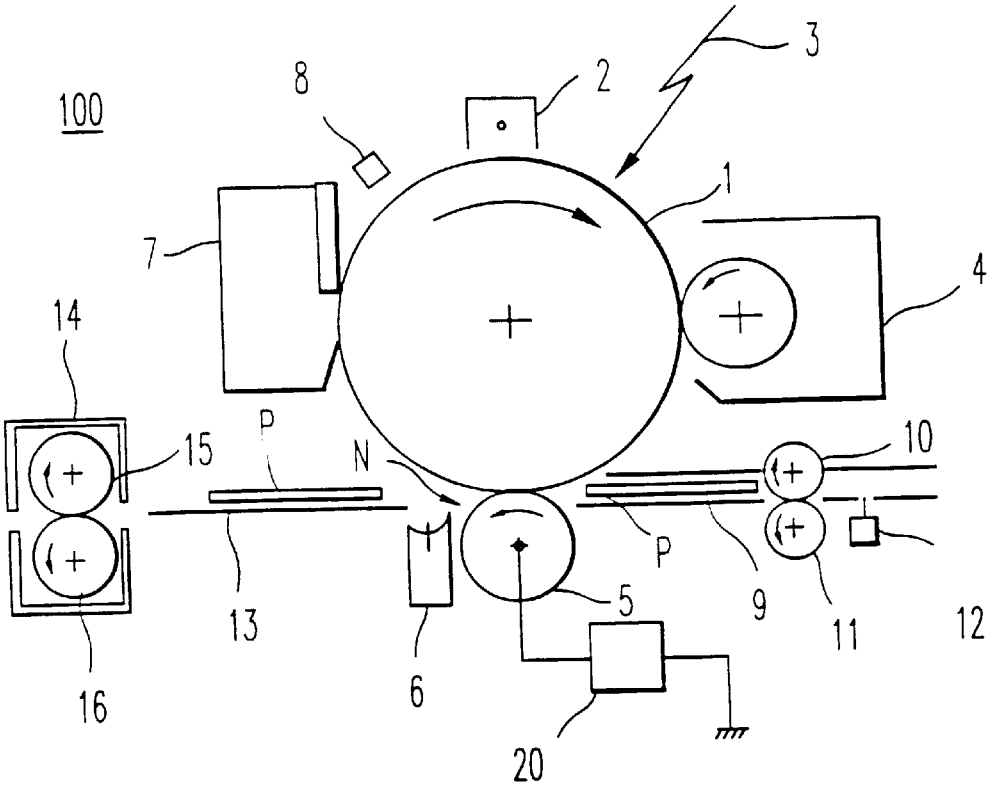
FIG. 1 is a schematic representation showing the general construction of an image forming apparatus embodying the present invention.

Referring now to the drawings, wherein like reference numerals designate identical or corresponding parts throughout the several views, and more particularly to FIG. 1 thereof, an image forming apparatus 100 embodying the present invention is shown. The image forming apparatus 100 has a rotatable photoconductive drum 1 and the following elements which may be conventional and disposed around the drum: a charging device 2 which charges the photoconductive drum 1, an exposing device 3 which includes, for example, a laser and a rotating polygonal mirror or alternatively a haloid lamp which forms a latent image on the photoconductive drum 1, a developing device 4 which develops the latent image to form a toner image on the photoconductive drum 1, a rotatable transfer roller 5 which rotates by accepting the rotatory force from the photoconductive drum 1 and transfers the toner image to a sheet of paper, a paper separating device 6 including an electrode which separates the sheet of paper after the toner transfer operation is performed, a cleaning device 7 which cleans residual toner on the photoconductive drum 1, and a discharging lamp 8 which discharges an electric charge on the photoconductive drum 1. The photoconductive drum 1 is rotated by a motor (not illustrated). A power source 20 which applies a transfer bias current to the transfer roller 5 is connected to the roller 5. The power source 20 includes a control board. The control board applies control signals to the power sources 20 in order to control the output timing of the bias current, the output current value, the polarity of transfer bias current from the power source 20 and so on.

In operation, the surface of the photoconductive drum 1 is negatively charged to −800V by the charging device 2. The charged surface of the drum 1 is exposed by the exposing device 3 which include a haloid lamp and an electric latent image is formed thereon. The charged surface of the drum 1 where light is not irradiated is developed by the developing device 4 in which toner is positively charged and a negative developing bias voltage is applied. The sheet of paper P is fed from a paper tray (not illustrated) to a pair of register rollers 10 and 11 after being sensed by a paper detection sensor 12. The sheet of paper P which has already reached the register rollers 10 and 11 is fed to the nip N by the register rollers 10 and 11 via a pair of paper guide plates 9, and the sheet of paper P is in pressured contact with the photoconductive drum 1 by the transfer roller 5 at the nip N.

Since a negative bias voltage is applied from the power source 20 to the transfer roller 5, a toner image which is positively charged is transferred from the photoconductive drum 1 to the sheet of paper P. The sheet of paper P is then discharged by a discharge electrode of the paper separating device 6 and then the sheet of paper P is separated from the photoconductive drum 1. The sheet of paper P on which the toner image is formed is then transported to a fixing device 14 which has a heated roller 15 and a pressure roller 16 via a guide plate 13, and the toner image is fixed on the sheet. The sheet of paper P is then discharged to a paper discharge tray (not illustrated). After the transfer operation, residual toner on the surface of the photoconductive drum 1 is cleaned by the cleaning device 7, and residual electric charge on the drum 1 is discharged by the discharge lamp 8.

Figure 2:
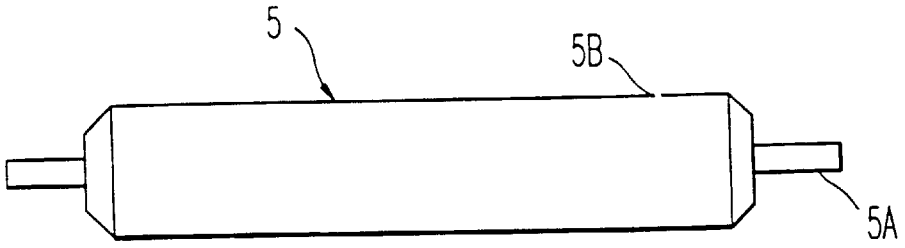
FIG. 2 is a schematic sectional view of a transfer roller utilized by the present invention.

FIG. 2 shows a schematic sectional view of the transfer roller 5. The transfer roller 5 includes an electrically conductive shaft 5*a* and an electrically conductive rubber layer 5*b* such as silicon rubber, urethane rubber, epichlorohydrin rubber, EPDM or combinations thereof coated on the shaft. The electrically conductive rubber layer 5*b* has an electric resistance between $10^{10}$ Ω·cm and $5\times10^{11}$ Ω·cm. The hardness of the rubber is less than 40° (JIS A). Since the electrical resistance of the ends of the roller 5 is smaller than the other portions of the roller 5, unusual discharge from the ends of the roller occurs. In order to prevent this unusual discharge, the ends of the roller 5 are tapered. The length of the roller 5 is smaller than that of the photoconductive drum 1.

Figure 3:
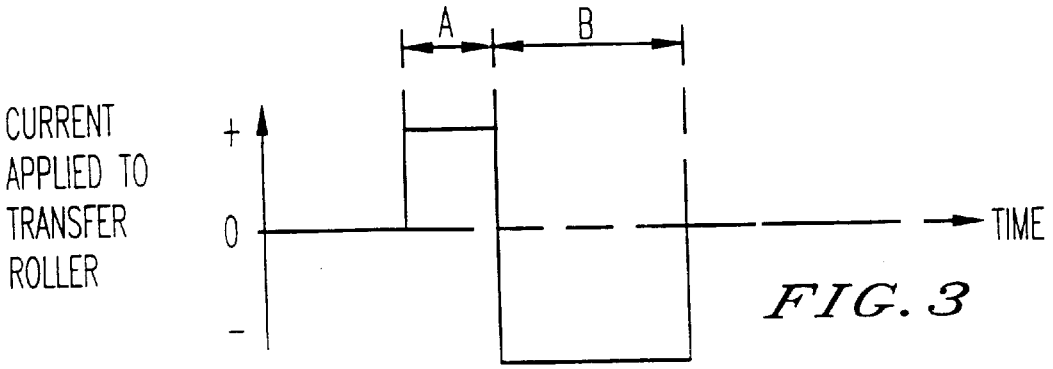
FIG. 3 is a timing diagram showing the cleaning bias of a device embodying the present invention.

In the present embodiment, the surface of the transfer roller 5 will become dirtied with toner because of a paper feed jam which prevents a sheet of paper from reaching the nip N and receiving toner from the drum 1. A bias cleaning operation is performed for the transfer roller 5 using electrical currents as shown in FIG. 3. Referring to FIG. 3, the cleaning bias current having a positive polarity is applied to the transfer roller 5 during time period A in order to transfer the regularly charged toner having positive polarity from the transfer roller 5 to the photoconductive drum 1. The positive polarity current applied to the transfer roller 5 causes the transfer roller 5 to be positively charged and a negative polarity current applied to the transfer roller 5 causes the roller to be negatively charged. Subsequently, the cleaning bias current having a negative polarity is applied to the transfer roller 5 during time period B in order to transfer the oppositely charged toner having a negative polarity from the transfer roller 5 to the photoconductive drum 1 during the time period B.

Figures 4, 5:
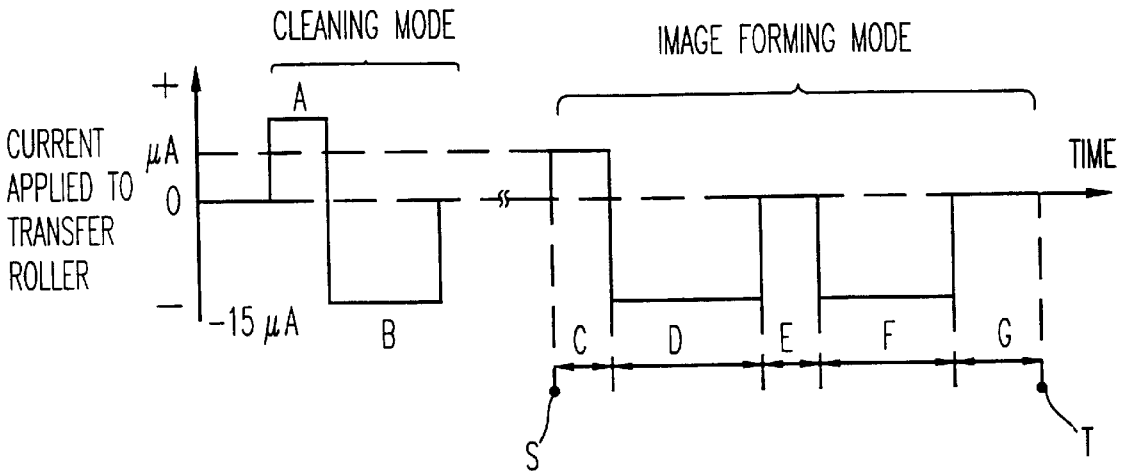
FIG. 4 is a timing diagram showing the cleaning bias and the transferring bias of a device in which the bias current C having a positive polarity is applied during the pre-image forming time period.
FIG. 5 is a table showing the result of an evaluation of dirt (toner) on a back side of a sheet of paper when the cleaning bias voltage and the transfer bias voltage are applied to the transfer roller according to FIG. 4.

During an experiment, it was discovered that the leading edge of the back side of the sheet of paper became dirty when the sheet of paper passed through the nip N in spite of a previous cleaning operation. As shown in FIG. 4, a cleaning operation occurs during time periods A and B and an image forming operation occurs between a start time S and an end or terminate time T. During the pre-image forming period of time C (i.e., from the time the photoconductive drum 1 starts its rotation after a print start switch is turned on (or a command to begin printing is received) until the leading edge of the sheet of paper reaches the nip), the transfer bias current, for example 8 μA, which charges the transfer roller to have the same polarity as the regularly charged toner is applied to the transfer roller 5. After the pre-image forming period of time, the transfer bias current is switched over from the positive polarity to the negative polarity, for example, −15 μA, and the sheet of paper passes through the nip, all during time period D. After the rear edge of the sheet of paper passed through the nip, the transfer bias current is switched to 0 μA during time period E which is an inter-image forming time period when no paper is at the nip N. When the next sheet of paper reaches the nip, the transfer bias current is switched to −15 μA at the beginning of time period F during which the next sheet is at the nip. After the rear edge of the sheet of paper passes through the nip after time period F, the transfer bias current is switched to 0 μA and the image forming operation ends after time period G which is a post-image forming time period.

FIG. 5 shows a result of an evaluation of dirt on a back side of a sheet of paper when the cleaning bias voltage and the transfer bias voltage is applied to the transfer roller as shown in FIG. 4. Referring to FIG. 5, the left-most vertical column A shows the cleaning bias current which is first applied to the transfer roller 5 during time period A of the cleaning operation, and the top row shows the cleaning bias current which is subsequently applied to the transfer roller 5 during time period B of the cleaning operation. Each of the time periods A and B of applying the cleaning bias current was 5 seconds. In FIG. 5, the symbol X indicates that the dirt (toner) was transferred to the back side of the leading edge of the sheet of paper. As shown in FIG. 5, if the transferring bias current having the same polarity as the regularly charged toner was applied during the pre-image forming period of time (time period C), dirt was transferred to the back side of the leading edge of the sheet of paper.

The reason why the dirt or toner was transferred to the back side of the leading edge of the sheet of paper during the process of FIG. 4 is as follows. There is oppositely charged toner in a developing device. The oppositely charged toner adheres to a non-image forming area of the photoconductive element when the photoconductive element faces the developing device when a contact type developing device that has toner on a developing roller contacts the photoconductive element. The oppositely charged toner on the photoconductive element is transferred to the transfer roller when an area of the photoconductive element where the oppositely charged toner is adhered reaches the nip N between the photoconductive element and the transfer roller, after the cleaning operation for the transfer roller is completed. When a sheet of paper passes through the nip, the oppositely charged toner on the transfer roller is transferred to a back side of the sheet of paper, and then the back side of the sheet of paper becomes dirty. Even if the cleaning operation for the transfer roller is executed during the cleaning time period of time, the aforementioned drawback cannot be solved, since this drawback occurs after the cleaning operation for the transfer roller.

When no cleaning bias current is applied to the transfer roller 5 during the pre-image forming time period of time, dirt or toner was also transferred to the back side of the leading edge of the sheet of paper.

Figures 6, 7:
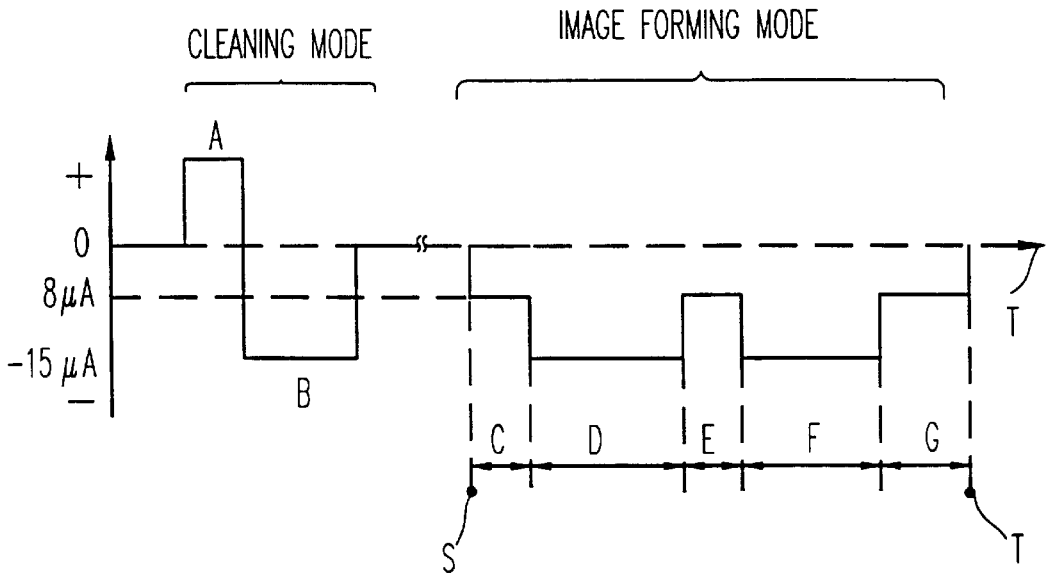
FIG. 6 is a timing diagram showing the cleaning bias and the transferring bias of a device in which the bias current having a negative polarity is applied during the pre-image forming time period C.
FIG. 7 is a table showing the result of an evaluation of dirt (toner) on a back side of a sheet of paper when the cleaning bias voltage and the transfer bias voltage are applied to the transfer roller according to FIG. 6.

In order to prevent the transfer of dirt or toner to the back side of the leading edge of the sheet of paper, the transferring bias current generating a charge on the transfer roller which has an opposite polarity to the regularly charged toner, for example −8 μA, is applied to the transfer roller 5 during the pre-image forming period of time C as shown in FIG. 6. Further, there is a similar current applied to the transfer roller during the inter-image forming time period E and the post-image forming time period E. When the paper passes between the nip N during time periods D and F, the transfer current is −15 μA.

FIG. 7 shows a result of the evaluation of dirt on a back side of a sheet of paper when the cleaning bias current and the transfer bias current is applied to the transfer roller as shown in FIG. 6. Referring to FIG. 7, the left-most vertical column A shows the cleaning bias current which is first applied to the transfer roller 5 during time period A of the cleaning operation, and the top row B shows the cleaning bias current which is subsequently applied to the transfer roller 5 during time period B of the cleaning operation. Each of the time periods A and B of applying the cleaning bias current was 5 seconds. In FIG. 7, the symbol ○ indicates that the dirt (toner) on the back side of the leading edge of the sheet of paper did not occur, and a the symbol X shows that the dirt (toner) was transferred to the back side of the leading edge of the sheet of paper. As shown in FIG. 7, dirt or toner was not transferred to the back side of the sheet of paper when A was +3 μA or +5 μA and B was any of the negative values, when A was +10 μA and B was −5 μA, −10 μA, −15 μA, or −20 μA, when A was +15 μA and B was −10 μA or −20 μA, or when A was +20 μA and B was −15 μA.

It is also possible to apply the transferring bias current having the opposite polarity as the regularly charged toner during the interimage forming time period (i.e., between successive copying operations), and during the post-image forming time period (i.e., after the last image area on the photoconductive drum 1 passes through the nip).

Figure 8:
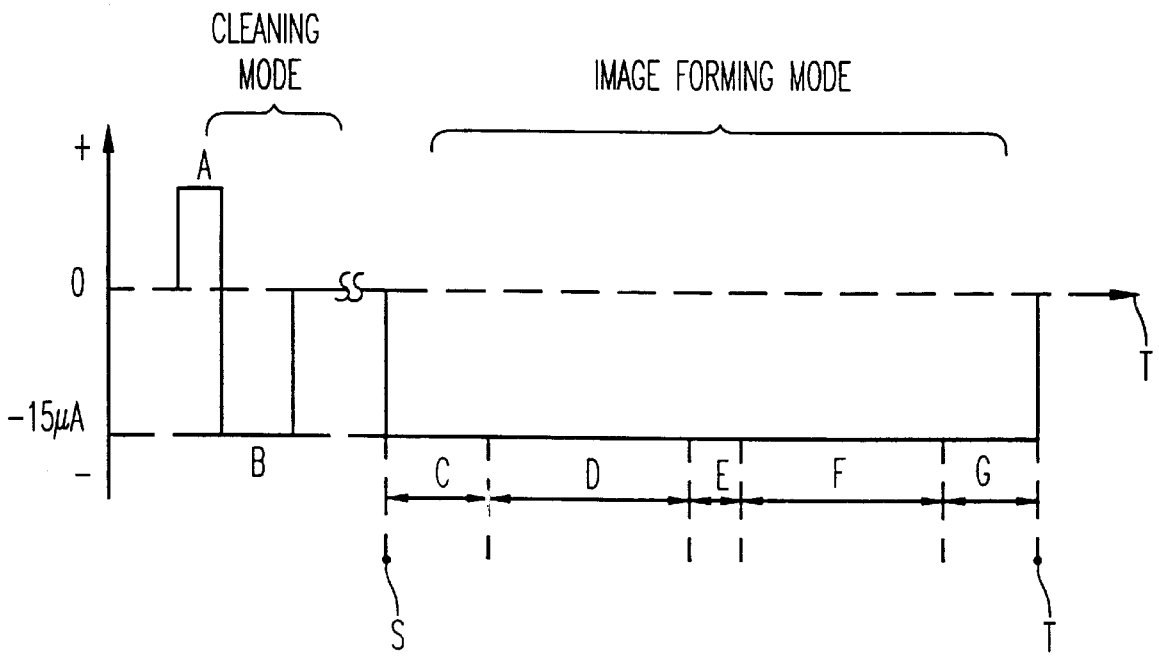
FIG. 8 is a timing diagram showing the cleaning bias and the transferring bias of a device in which the bias current having a negative polarity is applied during the pre-image forming time period.

FIG. 8 shows a timing diagram of the current applied to the transfer roller of a modified embodiment of the present invention. Referring to FIG. 8, a transferring bias current which is applied to the transfer roller 5 during the pre-image forming time period of time C, the inter-image forming time period E, and the post-image forming time period G was the same value as the transferring bias current, for example −15 μA, applied to the transfer roller during time periods D and F when a sheet of paper is at the nip N. According to the present embodiment, dirt or toner on the back side of the leading edge of the sheet of paper did not occur when the cleaning bias currents A and B were respectively 15 μA and −5 μA, or 20 μA and −5 μA.

Thus, the transfer of dirt or toner to the back side of the leading edge of the sheet of paper is prevented by applying the transferring bias current having the opposite polarity as the regularly charged toner to the transfer roller 5 during the pre-image forming time period of time.

The present invention may utilize a transfer belt as an alternative to the transfer roller. Further, it is also possible to provide a contacting type charging roller, a contacting type charging blade, or a contacting type brush as an alternative to the charging wire.

The present invention uses one or more control boards to perform the described functions. This board may be implemented using a conventional microprocessor or conventional general purpose digital computer programmed according to the teachings of the present application, as will be apparent to those skilled in the art. Appropriate software coding can readily be prepared by skilled programmers based on the teachings of the present disclosure, as will be apparent to those skilled in the software art. The invention may also be implemented by the preparation of applications specific integrated circuits or by interconnecting an appropriate network of conventional component circuits, as will be readily apparent to those skilled in the art.

Obviously, numerous modification and variations of the present invention are possible in light of the above teachings. It is therefore to be understood that within the scope of the appended claims, the invention may be practiced otherwise than as specifically described herein. It is to be noted that even though the cleaning performed by the timing diagrams illustrated in FIGS. 6 and 8 was not perfect in every case, there may still be a cleaning effect produced by the invention in these cases where the cleaning was not perfect or the back side was indicated as becoming dirty.

What is claimed is as new and is desired to be secured by Letters Patent of the United States is:

1. A method for transferring a toner image on an image carrier to a sheet, comprising the steps of:

applying a first bias current to a transferring device which contacts said image carrier when said sheet is not at a nip between said image carrier and said transferring device after said image carrier starts rotating after a print start request is input until said sheet reaches said nip;

applying a second bias current having a same polarity as said first bias current to said transferring device when said sheet is at said nip to transfer said toner image on said image carrier to said sheet;

applying a first cleaning bias current having a same polarity as said toner image to said transferring device before said print start request is inputted; and applying to said transferring device a second cleaning bias current having an opposite polarity as said first bias cleaning current before said print start request is inputted.

2. A method according to claim 1, wherein said step of applying said first bias current comprises:

applying said first bias current beginning when said image carrier starts rotating.

3. A method as claimed in claim 1, wherein said step of applying the first bias current comprises:

applying said first bias current during an inter-image forming time period.

4. A method as claimed in claim 1, wherein said step of applying the first bias current comprises:

applying said first bias current during a post-image forming time period.

5. A method as claimed in claim 1, wherein said step of applying the first bias current comprises:

applying said first bias current which is smaller than said second bias current.

6. A method as claimed in claim 1, wherein said step of applying the first bias current comprises:

applying said first bias current which has a same value as said second bias current.

* * * * *